United States Patent [19]

Hinden

[11] 4,446,245

[45] May 1, 1984

[54] RECOATING OF ELECTRODES

[75] Inventor: Jean M. Hinden, Chambesy, Switzerland

[73] Assignee: Diamond Shamrock Corporation, Dallas, Tex.

[21] Appl. No.: 356,168

[22] Filed: Mar. 8, 1982

[30] Foreign Application Priority Data

Apr. 6, 1981 [GB] United Kingdom ..... 8110711

[51] Int. Cl.[3] ..... C25B 11/10; C25B 11/08; B05D 5/12; B44D 1/18

[52] U.S. Cl. ..... 502/101; 204/290 F; 427/126.3; 427/126.5; 427/309; 427/380; 428/472

[58] Field of Search ..... 252/425.3, 413, 415; 204/290 F; 427/126.3, 126.5, 309, 380; 428/472; 502/101, 25

[56] References Cited

U.S. PATENT DOCUMENTS 3,684,543 8/1972 de Nora et al. ..... 427/309
3,773,554 11/1973 Scrutton et al. ..... 427/126.5
4,112,140 9/1978 Heikel et al. ..... 427/380
4,214,971 7/1980 Heikel et al. ..... 428/472
4,285,798 8/1981 Yoshida et al. ..... 427/126.3
4,318,795 3/1982 Bianchi et al. ..... 204/290 F

FOREIGN PATENT DOCUMENTS 522284 10/1976 U.S.S.R. ..... 204/290 F

*Primary Examiner*—P. E. Konopka
*Attorney, Agent, or Firm*—John P. Hazzard; Bruce E. Harang

[57] ABSTRACT

Used dimensionally stable electrodes having a valve-metal base and an originally conductive and electrocatalytic coating of e.g. ruthenium-titanium oxide are cleaned and activated by impregnation with a relatively dilute solution preferably containing only a decomposable platinum-group metal compound, followed by heating to enrich the old coating with platinum-group metal/oxide. A new outer electrocatalytic coating which is the same as or similar to the old coating is then applied on top.

10 Claims, No Drawings

RECOATING OF ELECTRODES

TECHNICAL FIELD

The invention relates to the recoating of previously-used dimensionally stable electrodes of the type having a valve metal base with an originally conductive and electrocatalytic coating containing at least one oxide of a platinum-group metal and at least one oxide of a valve metal optionally with at least one other metal oxide. By "valve metal" is meant titanium, tantalum, niobium, zirconium and tungsten although, as far as the base is concerned, this term is also meant to cover alloys of these metals or of at least one of these metals with another metal or metals, which when connected as anode in the electrolyte in which the coated anode is subsequently to operate, there rapidly forms a passivating oxide film protecting the underlying metal from corrosion by the electrolyte.

BACKGROUND ART

When dimensionally stable electrodes of the mentioned type have been used for an extended period of time, for example as anodes in an electrolysis cell for the production of chlorine and alkali metal hydroxides, the coatings are subjected to wear and damage and eventually the electrodes have to be recoated. Recoating is sometimes carried out after completely stripping off the remaining coating in a molten salt bath or by sandblasting followed by etching of the valve metal base, but advantageously in some instances the electrode surface is simply cleaned to remove loose material and foreign matter without removing adhering portions of the electrocatalytic coating, and a new removing adhering portions of the electrocatalytic coating, and a new electrocatalytic coating similar in composition to the old coating is applied over the old coating in a number of layers with drying and baking of each layer at about 300° C. to 500° C., as taught in U.S. Pat. No. 3,684,543. A modification in this so-called top-coating procedure claimed in USSR Patent No. 522.284 is to enrich the platinum-group metal oxide component of the new electrocatalytic coating by 10–20% compared to the old coating (eg. a $RuO_2$:$TiO_2$ molar ratio of 30:70 in the old coating and 33:66 in the new coating).

This top-coating procedure has a number of advantages over methods involving stripping of the old coating. For instance, it avoids the substantial loss of weight and weakening of the valve metal base produced by the stripping and etching treatments. However, the top-coating procedure is only considered technically and economically feasible if the electrode to be recoated meets certain standards, for example the remaining coating should be uniformly distributed and should contain a minimum amount of the platinum-group metal oxide behaving as an active electrocatalyst. In practice, therefore, the electrodes to be recoated are examined to determine the amount, the uniformity and activity of the electrocatalyst and only electrodes with an appreciable quantity of remnant active coating (several grams per square meter of the electrocatalyst, calculated on a metal weight basis) in good condition are selected for top-coating and the remaining badly worn electrodes are subjected to the complete stripping and recoating procedure, despite its disadvantages.

DISCLOSURE OF INVENTION

The invention, as set out of the claims, provides an improved top-coating procedure wherein after cleaning of the electrode surface and before application of the new electrocatalytic coating, which is the same as or of similar composition to the old coating, the electrode surface is subjected to an activating procedure.

The activating procedure involves the application of one or more coats of a solution of at least one decomposable platinum-group metal compound, allowing each coat of the solution to impregnate the old coating, drying and baking to decompose the platinum-group metal compound.

This solution used for activating the old coating differs from the solution used for applying the new coating. Firstly, the activating solution preferably does not contain any valve-metal compound (or optional compound of another metal) which is an essential major component of the coating solution for the new top-coating. Secondly, it will usually be somewhat more dilute (in terms of its metal content) than the top-coating solution. Generally the activating solution will contain 1–35 g/l (as metal) of the decomposable platinum-group metal compound(s) and any other metal compounds, preferably 5–15 g/l of the platinum-group metal compound(s), whereas the top-coating solution is more concentrated in metals and contains about 35–150 g/l (as metal) of the platinum-group metal and other metal compounds. Activating solutions containing about 1/10 the platinum-group metal compound used in the top-coating solution can be used to advantage. Also, it is not necessary for compounds of the same platinum-group metals to be used in the activating solution in the top-coating solution. Thus, for example, for a coating consisting of a mixed crystal of ruthenium-titanium oxide, the activating solution may contain only an iridium compound, a mixture of iridium and ruthenium compounds, or a rhodium compound, other combinations being possible.

Although it is preferred that the activating solution should contain decomposable platinum-group metal compound(s) only, to the exclusion of any additive metals, it is also possible to use activating solutions which also contain at least one decomposable compound of at least one further element generally in a smaller amount than the platinum-group metal compound(s). Preferred additives are compounds of cobalt, manganese, tin, bismuth, antimony, lead, iron and nickel which decompose into conductive and electrocatalytic oxides which enhance the electrocatalytic activity of the main platinum-group metal/oxide electrocatalyst. However, compounds of gold, silver, chromium, molybdenum, lanthanum, tellurium, sodium, lithium, calcium, strontium, copper, beryllium, boron and phosphorus may also be included in appropriate small quantities. Preferably, the activating solution will not contain any decomposable valve-metal compounds since the purpose of the activating solution is to enrich the existing valve-metal oxide matrix in the old coating with fresh electrocatalyst. However small quantities of valve metal compounds, up to about 10% by weight of the valve metal to the platinum-group metal(s), can be included without seriously impairing the activating effect.

Preferably, the activating solution contains an acid (notably HCl, HBr, HI or HF) or another agent (e.g. NaF) which attacks valve metal oxide throughout the old porous coating and converts it into ions of the valve metal which are mixed with the platinum-group metal compound(s) in the activating solution and are converted into a compound of the valve metal and the platinum-group metal and/or oxide during the baking step. Thus, when the baking is carried out in air or another oxidizing atmosphere, the platinum-group metal from the activating solution forms a mixed platinum-group-valve metal oxide with valve ions from the old coating. In this manner, the old coating is enriched with the added platinum-group metal/oxide electrocatalyst which becomes integrated in the old, porous coating.

In addition to enrichment by the addition of new electrocatalyst, the described procedure involving etching of the old valve metal oxide matrix has the effect of reactivating the old coating by disengaging sites of the electrocatalyst that had become blocked and disactivated by surrounding non-conducting valve metal oxide.

Also, the added electrocatalyst which has diffused or penetrated right through the pores of the old coating impregnates and activates any passivating layer of valve metal oxide that has formed under the old coating in the porous places. This takes place by the same mechanism as described above for enrichment of the coating.

In cases where the cleaned electrode has exposed areas of valve metal/valve metal oxide from which portions of the old coating have been removed, or which are formed by new welded-in sections of valve metal, the electrocatalyst added in the activating procedure impregnates any existing valve metal oxide barrier film and advantageously is incorporated in a fresh valve metal oxide barrier film grown up from the valve metal base. Again, this takes place by the acid or other agent in the activating solution attacking the valve metal or valve metal oxide of the uncoated section, and converting it into valve metal ions which are converted into an oxide or other compound of the valve metal during the baking step. In this way, in the uncoated exposed areas of the electrode, there is formed a barrier layer film of the valve metal compound incorporating the platinum-group metal and/or oxide. This barrier layer will usually be a mixed oxide of the platinum-group metal(s) and valve metal(s).

it is important to ensure that the electrocatalyst formed by the activating procedure should not form a separate intermediate coating between the old and the new coatings creating a zone of weakness which would be detrimental to adherence of the new coating. This can be achieved by a combination of measures: making the activating solution quite dilute; allowing the activating solution to slowly diffuse into and impregnate the old coating, usually prior to drying or during the first stage of a multi-stage drying procedure; and avoiding applying too many coats of the activating solution.

To obtain a satisfactory activation, the old coating is usually enriched with about 0.1–1 g/m$^2$, as metal, of the platinum-group metal and/or oxide coatings particularly coatings which include a porous anchorage layer, it is possible to incorporate up to about 2 g/m$^2$, as metal, of the platinum-group metal and/or oxide in the old coating during the activation procedure without forming an undesirable intermediate coating between the old and new coatings.

Optionally, the activation procedure may include the step of heating the electrode in a non-oxidizing atmosphere, for example in an inert gas for instance argon, a reducing atmosphere such as ammonia or carbon monoxide, or under vacuum, at a temperature of 350°–650° C. prior to or after applying the activating solution. This procedure is particularly useful whenever the old coating has a passivating valve-metal oxide layer at the coating/base interface, either as a preformed barrier or anchorage layer or a layer which has developed during use of the electrode. A typical example would be a preformed anchorage layer formed of plasma-sprayed titanium sub-oxide which is initially conductive and is impregnated/coated with an operative coating of, e.g. ruthenium-titanium oxide, and which during use has progressively become oxidized to poorly conducting titanium dioxide. By subjecting such electrodes to controlled heating in a non-oxidizing atmosphere for a period of at least about 20 minutes and usually about 45–90 minutes or even longer and advantageously at a temperature in the region of 550°–600° C., it is possible to reconvert the poorly conducting valve-metal oxide layer such as titanium dioxide into a conductive sub-oxide by the diffusion of valve-metal atoms up from the base. By carrying out this special heating procedure after application of the activating solution in one or several coats, the platinum-group metal compound(s) will decompose to an electrocatalyst which is wholly or predominantly metal and which may then be oxidized during baking of the top-coating solution in an oxidizing atmosphere.

BEST MODES FOR CARRYING OUT THE INVENTION

The following examples illustrate how the invention may be carried out in practice.

EXAMPLE I

After removal from a diaphragm chlor-alkali cell, a titanium-based anode is washed in water and scrubbed to remove any loose material. The electrocatalytic coating consisting of a mixed crystal of $RuO_2$:$TiO_2$ in a molar ratio of 30:70 still adhered well and was found to contain approximately 4 g/m$^2$ of ruthenium (as metal). This coating is judged suitable for top-coating, in which case the usual procedure would be to subject the anode to mild etching in a 20% by weight solution of HCl, and apply several layers of a recoating solution containing ruthenium and titanium compositions in a 30:70 molar ratio with drying and baking of each layer, and repeating this until the coating contained a standard loading of the electrocatalyst, 12 g/m$^2$ ruthenium (as metal) in this instance.

Instead, after the mild etching in HCl, the old coating can be activated in accordance with this invention by applying four coatings of a solution consisting of 6 ml n-propanol, 0.4 ml HCl (concentrated) and 0.1 g of iridium and ruthenium chlorides in a weight ratio of 2:1. Each applied coat is allowed to penetrate into the old coating for several minutes, then is slowly dried at approximately 80° C., and baked in air at 500° C. for 7 minutes after each coating. The amount of extra platinum-group metal oxide electrocatalyst incorporated into the old coating in this way is approximately 0.5 g/m$^2$ of iridium and ruthenium, calculated as metals.

Then, a top-coating of 30:70 $RuO_2$.$TiO_2$ is applied in several coats in the conventional manner, using a solution of 6 ml n-propanol, 0.5 ml HCl (concentrated), 3 ml butyl titanate and 1 g of $RuCl_3$, which is brushed on, dried and baked in air at 500° C. for 7 minutes after each coat. Top-coating is terminated when the added top-coating contains 4 g/m$^2$ of ruthenium, making a total electrocatalyst loading of approximately 8.5 g/m$^2$ of the platinum-group metals.

The lift expectancy of the activated and top-coated electrode is approximately the same as the non-activated and top-coated electrode containing considerably more platinum-group metal in normal electrolysis conditions without any significant oxygen evolution.

When the same activating and top-coating procedure is carried out for the anodes of membrane chlor-alkali cells (in which a problem of back migration of OH ions through the membrane is detrimental to the anode coating lifetime), or cells in which there is substantial oxygen formation, such as in chlorate cells, the activated and recoated electrode should have a substantially increased life expectancy compared to standard top-coated electrodes.

EXAMPLE II

After removal from a flowing mercury chlor-alkali cell, a titanium based anode is washed in water and scrubbed to remove loose material. The electrocatalytic coating consisting of a mixed crystal of $RuO_2.TiO_2$ in a molar ratio of 30:70 still adhered well to parts of the substrate, but in some places had been burnt away by short circuit contacts with the mercury amalgam. The coating contained on average 2.5 g/m$^2$ of ruthenium (as metal), but was unevenly distributed. This coating is judged unsuitable for top-coating by the usual method, and the procedure normally adopted with such a badly-damaged and worn coating would be complete stripping of the coating, either in a salt melt or by sandblasting, followed by strong etching and recoating.

Instead, the electrode is mild etched, activated and top-coated in accordance with this invention. Activation and top-coating can be achieved exactly as set out in Example I, with the top-coating procedure repeated to add for example 10 g/m$^2$ of ruthenium to the surface. It may however be preferred to use an activating solution containing only iridium chloride. Also, for very badly damaged anodes, it may be useful to increase the quantity of activating platinum-group metal oxide up to about 1.0 g/m$^2$ as metal.

The activating and top-coating procedure of this invention also applies to damaged mercury cell anodes in which part of the titanium structure is so badly burnt that it has to be cut out and a new section welded in.

For damaged anodes with exposed areas of the valve-metal base from which portions of the old coating have been removed or which are formed by new welded-in sections of valve metal, the previously described mild etch can be replaced by a somewhat more aggressive etch. Also, in this instance, it is important for the activating solution to contain an agent such as HCl which attacks the valve metal in the exposed areas and converts the valve metal into ions which are converted to a valve metal compound, usually the oxide, during the baking so that in the exposed areas there is formed a barrier layer film of valve metal oxide or other compound incorporating the activating platinum-group metal(s) and/or oxide(s), without leaving a separate layer of the platinum-group metal(s) and/or oxide(s) which is not firmly bonded to the substrate.

EXAMPLE III

The activating and top-coating procedures described in Examples I and II can advantageously be adopted for a diaphragm or membrane cell anode having an active coating consisting of approximately 25% $RuO_2$, 55% $TiO_2$ and 20% $SnO_2$, all by weight. Activation of such a used electrode prior to recoating may be carried out using the activating solution of Example I or a similar solution containing 0.1 g of ruthenium chloride only. Alternatively, the activating solution may for example contain 0.1 g of ruthenium and tin chlorides in a 2:1 or 5.4 metal weight ratio.

EXAMPLE IV

After removal from a chlorate production cell on account of an abrupt rise in electrode potential, a titanium-based electrode with a ruthenium-titanium oxide mixed crystal coating (mol ratio 30:70) was inspected for the purposes of recoating. The coating was fairly uniform, containing on average 4.4 g/m$^2$ of ruthenium, and adhered well but because of the poor electrocatalytic properties reflected by the high electrode potential, was judged unsuitable for top-coating. The normal procedure for such an electrode would thus be complete stripping of the old coating, either in a salt melt or by sandblasting, followed by strong etching and recoating with a new coating containing, e.g. 10 g/m$^2$ of ruthenium.

Instead, the electrode is mild etched by immersion for 10 minutes in a boiling 20% by weight solution of HCl, then activated and top-coated in accordance with this invention. Activation was carried out by applying four coats of a solution of 6 ml n-propanol, 0.4 ml HCl (concentrated) and 0.1 g iridium chloride. Each coat was allowed to penetrate into the old coating and dry for about 5 minutes at room temperature, then baked in air at 480° C. for 7 minutes after each coating. The amount of iridium oxide incorporated into the old coating in this way was about 0.6 g/m$^2$, calculated as iridium metal.

The activated electrode was then top-coated using the same solution and procedure as in Example I, except that baking was carried out at 480° C. for 10 minutes after each coat. Top-coating was terminated when the added top-coating contained approximately 5 g/m$^2$ of ruthenium, making a total electrocatalyst loading of about 10 g/m$^2$ (4.4+5 g/m$^2$ of Ru and 0.6 g/m$^2$ of Ir).

This activated and top-coated electrode was subjected to an accelerated lifetime test in 150 g/l $H_2SO_4$ at 45° C. with an anode current density of 7.5 kA/m$^2$. The lifetime of the electrode was 152 hours, compared to a lifetime of about 30 hours for a standard electrode having a ruthenium-titanium oxide coating containing 10 g/m$^2$ of ruthenium. Also, the activated and top-coated electrode had a stable half-cell chlorine potential of 1.54 V vs NHE, measured in a 300 g/l solution of NaCl at 70° C. (the measured value not being corrected for ohmic drop). The corresponding half-cell chlorine potential of the non-activated electrode with the old coating was initially 2.97 V rising rapidly to 3.6 V.

I claim:

1. A method of recoating previously-used dimensionally stable electrodes having a valve metal base and an originally conductive and electrocatalytic coating containing at least one oxide of a platinum-group metal and at least one oxide of a valve metal optionally with at least one other metal oxide, which comprises cleaning the electrode surface by removing loose material and foreign matter without removing adhering portions of the coating, and applying a new electrocatalytic coating similar in composition to the old coating over the old coating in a number of layers with drying and baking of each layer, characterized by activating the electrode surface after the cleaning and before application of the new electrocatalytic coating by applying to the cleaned electrode surface one or more coats of an essentially valve-metal free solution containing at least one decomposable compound of a platinum-group metal not present in said old or new coatings, allowing each coat of said solution to impregnate the old coating, drying and baking each applied coat to enrich the old coating with platinum group metal and/or oxide, said solution also containing an agent which attacks valve metal oxide in the old coating and converts it into ions of the valve metal which mix with compound(s) of platinum group metal and form compound(s) of valve metal and platinum-group metal and/or oxide during the baking step.

2. The method of claim 1, wherein the baking is carried out in an oxidizing atmosphere whereby the platinum-group metal from said solution forms a mixed platinum-group-valve metal oxide with valve metal ions from the old coating.

3. The method of claim 1 or 2, wherein after cleaning the electrode to be recoated has exposed areas of valve metal which are to be recoated with the new coating, said agent of the solution also attacking valve metal and converting valve metal from said exposed areas of the base into ions which are converted into a compound of the valve metal during the heating step to form in said exposed areas a barrier layer film of the valve metal compound incorporating the platinum-group metal and/or oxide.

4. The method of claim 1 wherein said solution also contains at least one decomposable compound of a non-valve metal, the amount of such non-valve metal compound(s) being less than the amount of platinum-group metal compound(s) therein.

5. The method of claim 4, wherein the activating solution contains at least one decomposition compound of cobalt, manganese, tin, bismuth, antimony, lead, iron or nickel.

6. The method of claim 1 or 4, wherein the activating solution contains 1–35 g/l, as metal, of the platinum-group metal and other metal compound(s).

7. The method of claim 6, wherein the activating solution contains 5–15 g/l, as metal, of the platinum-group metal compound(s).

8. The method of claim 6, wherein the new electrocatalytic coating is deposited from a solution which is more concentrated in metals than the activating solution and contains 35–150 g/l, as metal, of platinum-group metal and other metal compounds.

9. The method of claim 1, wherein the old coating is enriched with 0.1–1 g/m$^2$, as metal, of platinum-group metal and/or oxide by the activating procedure.

10. The method of claim 1, wherein the activation includes the step of heating the electrode in a non-oxidizing atmosphere at a temperature of 350°–650° C. prior to or after applying the activating solution.

* * * * *